United States Patent [19]

Shafer et al.

[11] 3,946,834

[45] Mar. 30, 1976

[54] SELF STORING FIRE ESCAPE LADDER

[76] Inventors: Simon Shafer, 196-12 Keno Ave., Holliswood, N.Y. 11423; Joseph Gilbert, 210 Pond X, Lawrence, N.Y. 11559

[22] Filed: Feb. 27, 1975

[21] Appl. No.: 549,618

[52] U.S. Cl. ..... 182/164; 182/206

[51] Int. Cl.[2] ..... E06C 5/26; E06C 1/52

[58] Field of Search ..... 182/163, 164, 206

[56] References Cited

UNITED STATES PATENTS

| | | | |
|---|---|---|---|
| 119,161 | 9/1871 | Luckenbach | 182/164 |
| 194,082 | 8/1877 | Falk | 182/164 |
| 381,429 | 4/1888 | Scott | 182/163 |
| 1,696,357 | 12/1928 | Johnson | 182/163 |
| 2,628,011 | 2/1953 | Buechler | 182/164 |
| 3,315,762 | 4/1967 | Torrey | 182/164 |

FOREIGN PATENTS OR APPLICATIONS

| | | | |
|---|---|---|---|
| 1,447,309 | 6/1966 | France | 182/164 |

*Primary Examiner*—Reinaldo P. Machado

[57] ABSTRACT

A self storing fire escape ladder of foldable type, including a plurality of pivotally interconnected rung sections and enlarged hook means for engaging a window sill or similar structure during use. The hook means is of effective width less than that of the rung sections, and so contoured that when the rung sections are folded against each other to form a compact unit, the hook means may at least partially encircle the rung sections to hold them in mutually folded relation and form carrying handle means. Optional latching means is provided to prevent movement of the hook means relative to the compact unit when the former is employed as a carrying handle.

2 Claims, 3 Drawing Figures

FIG. 1
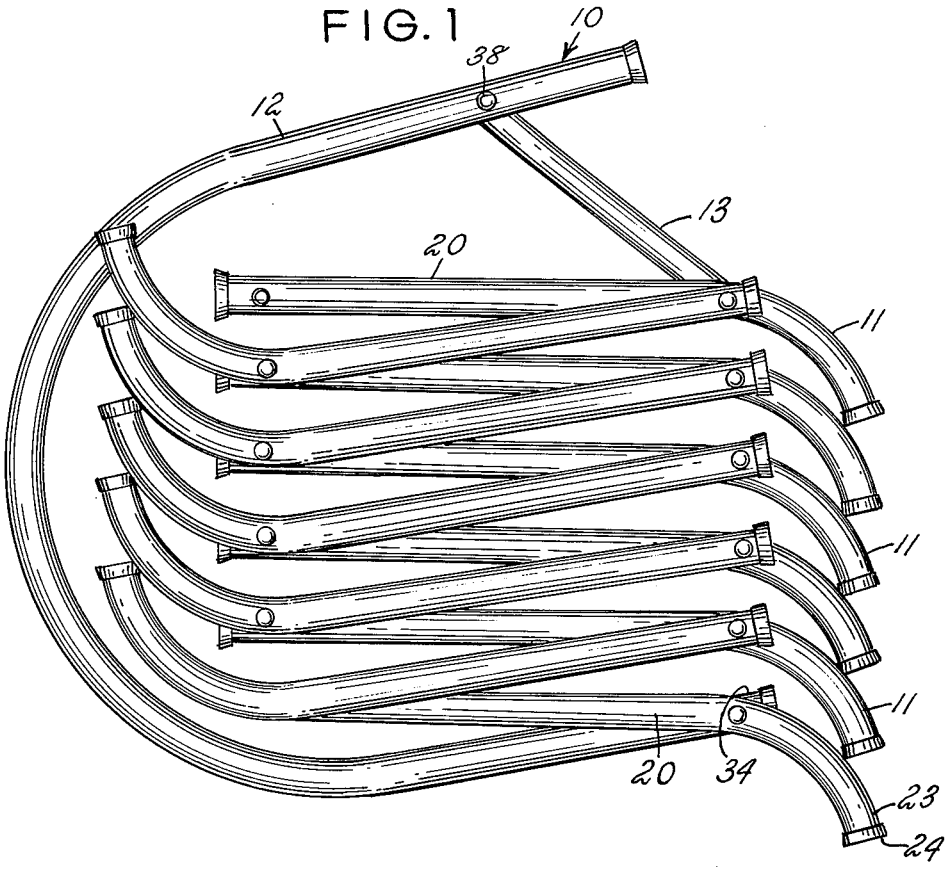
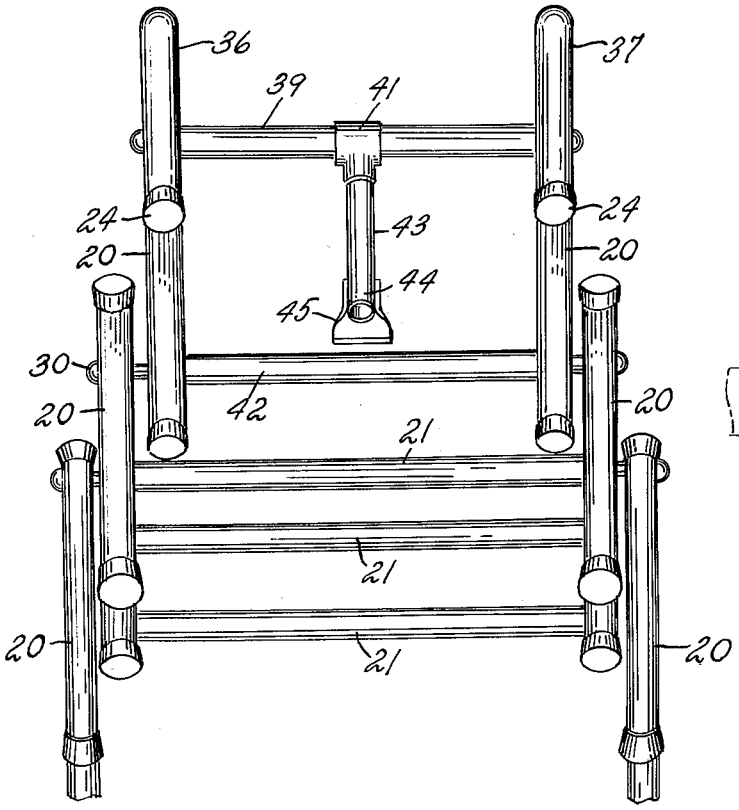
FIG. 2
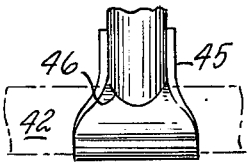
FIG. 3

SELF STORING FIRE ESCAPE LADDER

BACKGROUND OF THE INVENTION

This invention relates generally to the field of folding emergency ladders suitable for assisting the occupants of a burning building to escape through an available window or other opening. Such ladders are well known in the art, and the invention lies in specific constructional details which permit the device to be conveniently stored in a small space while maintained in folded condition, and readied for instant use as required.

U.S. Pat. No. 3,315,762 to Torrey illustrates the desirability of forming ladders of this type so that they may be conveniently stored in folded compact condition while supported within a stand adapted to rest upon a floor surface adjacent an escape window. A stand supporting the folded ladder rungs serves as a window engaging hook during use.

While constructions of this type are of obvious utility, the presence of the stand contributes to the floor area occupied during storage, as well as the effective height of the stored device. Additionally, such constructions do not provide means for preventing unfolding of the ladder sections should the device be accidentally overturned.

SUMMARY OF THE INVENTION

Briefly stated, the invention contemplates the provision of a folding fire escape ladder of the type disclosed in U.S. Pat. No. 412,752 to Hewitt, in which the hook means for engaging a window sill attached to the uppermost rung section is so contoured that it alternately serves as a storage means for enclosing rung sections in folded condition to permit individual unfolding when the device is used. The hook means also includes latching means selectively engageable with at least one of the rung sections to maintain the hook means in position, so that the device may be hand carried. The hook means is of effective width less than that of any of the rung sections, so as to readily fit between the side rails of each rung section when disposed in juxtaposed stacked mutual relation.

BRIEF DESCRIPTION OF THE DRAWING

In the drawing, to which reference will be made in the specification, similar reference characters have been employed to designate corresponding parts throughout the several views.

FIG. 1 is a side elevational view of an embodiment of the invention showing the same in folded condition.

FIG. 2 is an end elevational view thereof, as seen from the right hand portion of FIG. 1.

FIG. 3 is an enlarged fragmentary view showing optional latching means.

DETAILED DESCRIPTION OF THE DISCLOSED EMBODIMENT

In accordance with the invention, the device, generally indicated by reference character 10 comprises broadly: a plurality of rung sections 11, sill-engaging hook means 12 and latching means 13.

The rung sections 11, as illustrated, may be of any suitable configuration, each section including a pair of side rails 20 interconnected by at least one rung or step 21. The lowermost rung section will include a second rung at the lower end thereof. The side rails and rung may be of any suitable form, and may be conveniently formed from extruded or welded aluminum tubing offering the advantages of substantial strength and light weight. The end portions 23 thereof may be fitted with protective synthetic resinous caps 24, as is well known in the art. Most conveniently, the rung sections are formed so that each alternate rung section is of the same effective width, whereby they may conveniently interconnected for mutual pivotal movement, and be capable of being stacked as shown in FIG. 1, wherein the side rails of alternate rung sections overlie each other. The rungs 21 are also preferably formed as hollow tubular sections penetrated by threaded shafts (not shown) which hold the rung sections together, and which may be fitted with capnuts 30, well known in the art.

The hook means 12 is pivotally connected to the uppermost rung section 11 at a first end 34 thereof. It will be noted that the uppermost rung section is of the narrower of the two widths of rung sections employed, so that the effective width of the hook means 12 is still less wide, facilitating engagement of the folded rung sections as shown in FIG. 1. The means 12 includes first and second U-shaped members 36 and 37, respectively, interconnected at a point 38 adjacent the free ends thereof by a cross piece 39.

The latching means 13, as has been mentioned, is optional, and serves to selectively interconnect the cross piece 39 with one of the rungs 21 so as to prevent relative movement between the hook means 12 and the rung sections 11 when the device is in folded condition. This enables the hook means 12 to be manually grasped at any portion thereof, as when carrying the device, without fear of permitting the folded rung sections to accidentally unfold. While the latching means may be a captive chain surrounding the cross piece 39 and any of the rungs 21, it is conveniently formed to include a pair of bracket members 41 pivotally interconnecting with the outer surface of the cross piece 39 and supporting a laterally extending shaft 43 having an oppositely disposed end 44 mounting a single bracket member 45 which cooperates with a recess 46 in the end 44 to resiliently engage the outer surface 42 of the interconnected rung 21. The device 10 will normally be stored in this condition until used, and upon the occurrence of an emergency, the bracket member 45 is disengaged, the shaft 43 moved outwardly, following which the hook means 12 may be disengaged from the rung sections 11, engaged with a window sill, and the rung sections allowed to unfold in well known manner.

It will be observed that in folded condition, the hook means 12 occupies very little additional volume over that occupied by the folded rung sections 11 themselves, and further, that the device may be stored in any desired orientation relative to a floor surface, depending upon the availability of the ladder.

We wish it to be understood that we do not consider the invention limited to the precise details of structure shown and set forth in this specification, for obvious modifications will occur to those skilled in the art to which the invention pertains.

We claim:

1. An improved self-storing fire escape ladder comprising: a plurality of rung sections, each including a pair of parallel side rails, and at least one interconnecting rung extending laterally between said side rails, means pivotally interconnecting a plurality of said rung sections whereby the same may be selectively extended for use and folded upon each other to form a compact unit; and a generally U-shaped hook means pivotally connected at one end thereof to an uppermost of said rung sections, said hook means being of an effective width less than that of any of said sections, whereby the same, upon pivoting relative to said compact unit may substantially enclose said compact unit by fitting between the side rails thereof and prevent accidental separation thereof; and latching means for selectively interconnecting portions of said hook means and the lowermost of said rung sections to maintain said hook means in enclosed condition relative to said compact unit.

2. Structure in accordance with claim 1, said hook means including a transversely-extending brace member, said latching means including a shaft pivotally mounted at one end thereof to said brace member, and having means at an opposite end thereof selectively engaging a rung on one of said rung sections.

* * * * *